US009976779B2

(12) United States Patent
Xu

(10) Patent No.: US 9,976,779 B2
(45) Date of Patent: May 22, 2018

(54) CRYOGENIC REFRIGERATOR

(71) Applicant: SUMITOMO HEAVY INDUSTRIES, LTD., Tokyo (JP)

(72) Inventor: Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 138 days.

(21) Appl. No.: 14/921,017

(22) Filed: Oct. 23, 2015

(65) Prior Publication Data

US 2016/0123631 A1 May 5, 2016

(30) Foreign Application Priority Data

Oct. 29, 2014 (JP) ..... 2014-220594

(51) Int. Cl.

*F25B 9/14* (2006.01)
*F25B 9/06* (2006.01)
*F02G 1/043* (2006.01)

(52) U.S. Cl.

CPC ..... *F25B 9/14* (2013.01); *F02G 1/0435* (2013.01); *F25B 9/06* (2013.01); *F25B 9/145* (2013.01); *F25B 2309/001* (2013.01); *F25B 2309/003* (2013.01); *F25B 2309/1406* (2013.01); *F25B 2309/1412* (2013.01); *F25B 2309/1418* (2013.01)

(58) Field of Classification Search

CPC .... F25B 9/06; F25B 9/14; F25B 9/145; F25B 2309/1406; F25B 2309/1412; F25B 2309/1418; F25B 2309/001; F25B 2309/003; F25B 2309/1416; F25B 2345/003; F02G 1/0435

See application file for complete search history.

(56) References Cited

U.S. PATENT DOCUMENTS 3,600,903 A * 8/1971 Chellis ..... F25B 9/14 62/6
6,532,748 B1 * 3/2003 Yuan ..... F02G 1/0435 165/10

(Continued)

FOREIGN PATENT DOCUMENTS

JP S48-100236 U1 11/1973
JP 02-143058 A 6/1990

(Continued)

*Primary Examiner* — Keith Raymond
*Assistant Examiner* — Webeshet Mengesha
(74) *Attorney, Agent, or Firm* — HEA Law PLLC

(57) ABSTRACT

In a cryogenic refrigerator, a displacer defines an internal space, and circulates a working fluid in the internal space. A cylinder houses the displacer such as to enable it to reciprocate, and, at an interval from the bottom side of the displacer, forms an expansion space for the working fluid. A cooling stage is provided along an outer circumferential and bottom portion of the cylinder, in a location corresponding to the expansion space. A heat exchanger is arranged inside the expansion space and is thermally connected to the cooling stage. An end portion of the displacer on its expansion-space side has an opening that serves as an entry/exit port between the internal space and the expansion space for the working fluid. A working-fluid flow channel connects the internal space and the expansion space via the heat exchanger.

5 Claims, 4 Drawing Sheets

(56) References Cited

U.S. PATENT DOCUMENTS

| | | | | |
|---|---|---|---|---|
| 2002/0112484 | A1* | 8/2002 | Kim | F02G 1/043 62/6 |
| 2007/0157632 | A1 | 7/2007 | Saito | |
| 2013/0174582 | A1* | 7/2013 | Xu | F25B 9/14 62/6 |

FOREIGN PATENT DOCUMENTS

| | | | |
|---|---|---|---|
| JP | H10-122683 | A | 5/1998 |
| JP | 2002-257428 | A | 9/2002 |
| JP | 2006-284061 | A | 10/2006 |
| JP | 2013-142479 | A | 7/2013 |

* cited by examiner

CRYOGENIC REFRIGERATOR

RELATED APPLICATIONS

Priority is claimed to Japanese Patent Application No. 2014-220594, filed Oct. 29, 2014, the entire content of which is incorporated herein by reference.

BACKGROUND

Technical Field

Certain embodiments of the invention relate to cryogenic refrigerators that employ a high-pressure working fluid supplied from a compression apparatus to cause Simon (adiabatic) expansion and bring about cooling at cryogenic temperatures.

Description of Related Art

The Gifford-McMahon (GM) refrigerator is one example of refrigerators known to generate cryogenic temperatures. With GM refrigerators, inside a cylinder a displacer is reciprocated to change the volume of expansion space. Selective connecting, in response to the change in volume, of the discharge side and intake side of the refrigerator compressor with the expansion space expands the working fluid in the expansion space. The cooling therein brought about refrigerates the refrigeration target.

SUMMARY

In one embodiment, the present invention affords a cryogenic refrigerator including: a displacer defining an internal space, and being for circulating a working fluid in the internal space an internal space; a cylinder housing the displacer such as to enable the displacer to reciprocate, and forming, at an interval from a bottom surface of the displacer, an expansion space for the working fluid; a cooling stage provided along an outer circumferential and bottom portion of the cylinder in a location corresponding to the expansion space; a heat exchanger arranged inside the expansion space and thermally connected to the cooling stage; an opening furnished in an expansion-space-ward end portion of the displacer, the opening constituting an entry/exit port between the internal space and the expansion space for the working fluid; and a working-fluid flow channel connecting the internal space and the expansion space via the heat exchanger.

DETAILED DESCRIPTION

It is desirable to provide a technology for improving the refrigeration performance of a cryogenic refrigerator.

In refrigerators, including GM refrigerators constructed with a displacer, a clearance is provided between a cylinder and the displacer in order to cause the displacer to reciprocate inside the cylinder. A cooling stage is provided at an end portion of the cylinder on a low temperature side, and a portion of the clearance functions as a heat exchanger which performs heat exchange between the working fluid inside the clearance and the cooling stage.

Generally, in refrigerators, heat exchange is performed between the working fluid and the cooling stage when the working fluid which expands in an expansion space flows through the clearance and is discharged from the expansion space. Meanwhile, the working fluid supplied to the expansion space is not low enough in temperature to cool the cooling stage. Therefore, when the working fluid is supplied to the expansion space, even though the working fluid does not contribute to refrigeration, the working fluid flows through the clearance having significant flow channel resistance, thereby resulting in pressure loss in the refrigerator. Furthermore, there is a possibility of causing degradation of the refrigeration performance of the refrigerator. Therefore, in a displacer type refrigerator, it is considered that it is possible to further improve the flow pattern and heat exchange of the working fluid in the expansion space.

Hereinafter, certain embodiments of the invention will be described together with the drawings.

First Embodiment

Figure 1B:
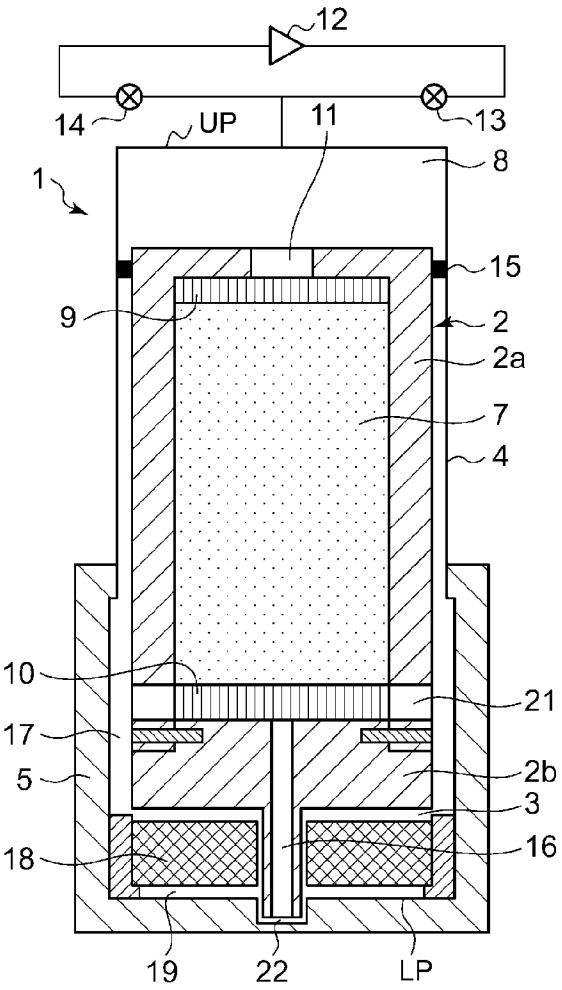
FIGS. 1A and 1B are diagrams schematically illustrating a cryogenic refrigerator according to one embodiment of the invention.
Figure 1A:
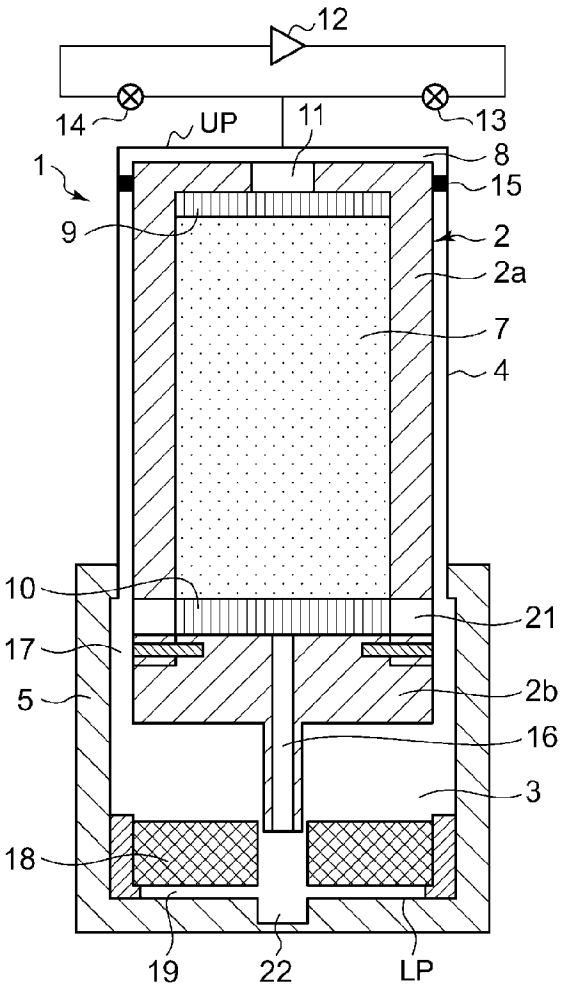

FIGS. 1A and 1B are diagrams schematically illustrating a cryogenic refrigerator 1 according to one embodiment of the invention. For example, the cryogenic refrigerator 1 according to the one embodiment is a Gifford-McMahon type refrigerator which uses helium gas as the working fluid. The cryogenic refrigerator 1 includes a displacer 2, a cylinder 4 which forms an expansion space 3 between the cylinder 4 and the displacer 2, and a bottomed cylindrical cooling stage 5 which is adjacent to the expansion space 3 and is positioned so as to surround the outside thereof. The cooling stage 5 functions as the heat exchanger which performs heat exchange between a cooling target and the working fluid.

A compressor 12 collects low-pressure working fluid from the intake side and compresses the working fluid to high-pressure, thereby supplying the high-pressure working fluid to the cryogenic refrigerator 1. For example, helium gas can be used as the working fluid, but the working fluid is not limited thereto.

The cylinder 4 accommodates the displacer 2 which can perform reciprocating movements in a longitudinal direction. For example, stainless steel is used for the cylinder 4 from the point of view of strength, thermal conductivity, helium blocking ability, and the like.

The displacer 2 includes a main body portion 2*a* and a bottom portion 2*b*. For example, a phenol resin and the like are used for the main body portion 2*a* of the displacer 2 from the point of view of density, strength, thermal conductivity, and the like. For example, a regenerator material is configured to be formed with wire gauze and the like. The bottom portion 2*b* may be configured to be formed with the same member as that of the main body portion 2*a*. In addition, the bottom portion 2*b* may be configured to be formed with a material having thermal conductivity higher than that of the main body portion 2*a*. In that case, the bottom portion 2*b* also functions as a heat conductive portion which performs heat exchange between the bottom portion 2*b* and the working fluid flowing inside the bottom portion 2*b*. For example, a material such as copper, aluminum, and stainless steel having thermal conductivity higher than that of at least the main body portion 2*a* is used for the bottom portion 2*b*. The cooling stage 5 is configured to be formed of copper, aluminum, and stainless steel, for example.

A scotch yoke mechanism (not illustrated) which drives the displacer 2 to reciprocate is provided at a high-temperature end of the displacer 2. The displacer 2 reciprocates between an upper dead center UP and a lower dead center LP inside the cylinder 4 along an axial direction of the cylinder 4. FIG. 1A is a schematic diagram illustrating a state where the displacer 2 is positioned at the upper dead center UP in the cryogenic refrigerator 1 according to the one embodiment. In addition, FIG. 1B is a schematic diagram illustrating a state where the displacer 2 is positioned at the lower dead center LP in the cryogenic refrigerator 1 according to the one embodiment of the invention.

The displacer 2 has a cylindrical outer circumference surface, and the inside of the displacer 2 is filled with the regenerator material. An internal space of the displacer 2 is configured to be a regenerator 7. An upper-end flow straightener 9 and a lower-end flow straightener 10 which respectively rectifies the flow of helium gas are provided on an upper end side and a lower end side of the regenerator 7.

An upper opening 11 which causes the working fluid to circulate from a room temperature chamber 8 to the displacer 2 is formed at the high-temperature end of the displacer 2. The room temperature chamber 8 is a space formed by the cylinder 4 and the high-temperature end of the displacer 2, and the volume thereof varies in accordance with reciprocating movements of the displacer 2.

A supply-exhaust common pipe among pipes which alternatively connect an intake-exhaust system formed with the compressor 12, a supply valve 13, and a return valve 14 is connected to the room temperature chamber 8. In addition, seal 15 is mounted between a portion near the high-temperature end of the displacer 2 and the cylinder 4.

An opening portion 21 is formed at a low-temperature end which is an end portion of the displacer 2 on the expansion space 3 side. The opening portion 21 serves as a gateway between the internal space of the displacer 2 and the expansion space 3 for the working fluid. In addition, a clearance 17 which connects the internal space of the displacer 2 and the expansion space 3 and serves as a flow channel for refrigerant gas is provided between an outer wall of the displacer 2 and an inner wall of the cylinder 4.

A flow channel 16 which connects the internal space of the displacer 2 and the expansion space 3 is formed at the bottom portion 2*b* of the displacer 2. The flow channel 16 is a conduit which is formed at the bottom portion of the displacer 2 so as to protrude in the expansion space 3. The flow channel 16 penetrates a center portion of the bottom portion 2*b* of the displacer 2, thereby being connected to the vicinity of a bottom portion of the expansion space 3. The flow channel 16 functions as a working fluid suction portion which returns the working fluid of the expansion space 3 to the internal space of the displacer 2. In addition, the flow channel 16 also functions as a working fluid venting portion which introduces the working fluid into the internal space of the displacer 2 to the expansion space 3.

The expansion space 3 is a space formed by the cylinder 4 and the displacer 2, and the volume thereof varies in accordance with reciprocating movements of the displacer 2. The cooling stage 5 which is thermally connected to the cooling target is disposed at a position corresponding to the expansion space 3 in the outer circumference and a bottom portion of the cylinder 4.

A heat exchanger 18 which is thermally connected to the cooling stage 5 is included inside the expansion space 3. In addition, a flow channel 19 which passes through the heat exchanger 18 and connects the internal space of the displacer 2 and the expansion space 3 is also included inside the expansion space 3. As illustrated in FIG. 1A and FIG. 1B, the heat exchanger 18 is included in the expansion space 3 on the bottom portion side. A clearance, which functions as the flow channel 19, exists between the heat exchanger 18 and the bottom portion of the expansion space 3. The working fluid flowed out of an end portion of the above-described flow channel 16 on the expansion space 3 side passes through the flow channel 19 and the heat exchanger 18 and is introduced into the expansion space 3. In addition, the working fluid which passes through the heat exchanger 18 from the expansion space 3 is collected in the internal space of the displacer 2 through the flow channel 19 and the flow channel 16.

In this manner, two flow channels which cause the internal space of the displacer 2 and the expansion space 3 to communicate with each other exist in the cryogenic refrigerator 1 according to the embodiment. A first flow channel is connected through the opening portion 21 and the clearance 17. A second flow channel is the flow channel which is connected through the flow channel 16, the flow channel 19, and the heat exchanger 18. The first flow channel is the flow channel which does not pass through the heat exchanger 18, in other words, makes a detour around the heat exchanger 18 and causes the internal space of the displacer 2 and the expansion space 3 to communicate with each other. The second flow channel is the flow channel which passes through the heat exchanger 18 and causes the internal space of the displacer 2 and the expansion space 3 to communicate with each other. Hereinafter, for convenience, the flow channel which is connected through the opening portion 21 and the clearance 17 may be referred to as "the first flow channel", and the flow channel which is connected through the flow channel 16, the flow channel 19, and the heat exchanger 18 may be referred to as "the second flow channel".

An receiver 22 which accommodates an end portion of the flow channel 16 on the expansion space 3 side is included in the bottom portion of the expansion space 3 at least when the displacer 2 is at the lower dead center LP. When the end portion of the displacer 2 on the expansion space 3 side is in a state of being accommodated in the receiver 22, the receiver 22 blocks circulation of the working fluid through the flow channel 16. Therefore, while the end portion of the displacer 2 on the expansion space 3 side is accommodated in the receiver 22, circulation of the working fluid stops in the above-described second flow channel. In this context, the receiver 22 functions as a valve of the flow channel 16.

The depth of the receiver 22, that is, the length of the displacer 2 along a stroke direction from a bottom surface of the expansion space 3 to a bottom surface of the receiver is equal to or less than half the length of stroke of the displacer 2. Therefore, in reciprocating movements of the displacer 2, at least when the displacer 2 is on the upper dead center UP side, the working fluid flows through the flow channel 16. When the displacer 2 approaches the lower dead center LP side and the end portion of the flow channel 16 on the bottom portion side of the expansion space 3 arrives at an entrance of the receiver 22, circulation in the working fluid flow channel 16 stops substantially. In this manner, the second flow channel is not open at all times during the reciprocating motions of the displacer 2. The second flow channel is the flow channel which is open when the displacer 2 is on the upper dead center UP side and is closed when the displacer 2 is on the lower dead center LP side.

As described above, the clearance 17 is a gap provided between the internal space of the displacer 2 and the expansion space 3. Meanwhile, the heat exchanger 18 is an aggregation of the wire gauze or slits. Therefore, the flow channel resistance of the working fluid in the heat exchanger 18 is smaller than the flow channel resistance of the clearance 17. In addition, the flow channel 19 is a gap between the heat exchanger 18 and the bottom portion of the expansion space 3. Therefore, the flow channel area of the flow channel 16 is greater than the flow channel area of the clearance 17, and has small flow channel resistance. Moreover, the flow channel area of the flow channel 16 is formed so as to be greater than the flow channel area of the clearance 17, and the flow channel resistance of the flow channel 16 is smaller than the flow channel resistance of the clearance 17.

The flow channel resistance of the entirety of the first flow channel is greater than the flow channel resistance of the entirety of the second flow channel. As a result, when the displacer 2 is on the upper dead center UP side, and the flow channel 16 is open, the working fluid is more likely to flow through the second flow channel than the first flow channel.

Subsequently, an operation of the cryogenic refrigerator 1 will be described.

At a certain point in time during the step of supplying the working fluid, the displacer 2 is positioned at the lower dead center LP of the cylinder 4 as illustrated in FIG. 1B. In this case, circulation of the working fluid through the flow channel 16 is blocked. As the supply valve 13 is open at the same time or at timing slightly deviated from when the displacer 2 is positioned at the lower dead center LP of the cylinder 4, the high-pressure working fluid is supplied from the supply-exhaust common pipe to the inside of the cylinder 4 via the supply valve 13. As a result, the high-pressure working fluid flows in the regenerator 7 inside the displacer 2 from the upper opening 11 which is positioned at the upper portion of the displacer 2. The high-pressure working fluid which flows in the regenerator 7 is supplied to the expansion space 3 via the opening portion 21 which is positioned at the lower portion of the displacer 2 while being cooled by the regenerator material.

As the high-pressure working fluid flows in the expansion space 3, the displacer 2 starts to move from the lower dead center LP toward the upper dead center UP. When the end portion of the flow channel 16 on the expansion space 3 side arrives at the entrance of the receiver 22 in the middle of the movement, the flow channel 16 is open. As a result, the working fluid of the internal space of the displacer 2 flows in the expansion space 3 not only via the opening portion 21 but also via the flow channel 16. Since most of the working fluid is supplied to the expansion space 3 during the first half in an intake step, a relatively small quantity of the working fluid flows in the expansion space 3 via the flow channel 16.

As the expansion space 3 is filled with the high-pressure working fluid, the supply valve 13 is closed. In this case, as illustrated in FIG. 1A, the displacer 2 is positioned at the upper dead center UP inside the cylinder 4. As the return valve 14 is open at the same time or at timing slightly deviated from when the displacer 2 is positioned at the upper dead center UP inside the cylinder 4, the working fluid of the expansion space 3 is decompressed and expands. The working fluid of the expansion space 3 being at a low temperature due to expansion absorbs heat of the cooling stage 5.

The displacer 2 moves toward the lower dead center LP, and the volume of the expansion space 3 is reduced. The working fluid is more likely to flow in the flow channel which passes through the second flow channel, that is, the heat exchanger 18, the flow channel 19, and the flow channel 16 than the flow channel which passes through the first flow channel, that is, the clearance 17 and the opening portion 21. Therefore, the working fluid mainly passes through the heat exchanger 18 and is collected in the displacer 2. The working fluid flowing through the second flow channel absorbs heat in the heat exchanger 18. Since the heat exchanger 18 is thermally connected to the cooling stage 5, as a result, the working fluid also absorbs heat of the cooling stage 5.

As the displacer 2 moves toward the lower dead center LP, the end portion of the flow channel 16 on the expansion space 3 side arrives at the entrance of the receiver 22 in the middle of the movement. When the end portion of the flow channel 16 on the expansion space 3 side arrives at the entrance of the receiver 22, circulation of the working fluid through the flow channel 16 is blocked. Therefore, the working fluid does not pass through the heat exchanger 18 and flows through the first flow channel, thereby being collected in the displacer 2. Since most of the working fluid is collected in the displacer 2 during the first half in an exhaust step, a relatively small quantity of the working fluid flows through the first flow channel and is collected in the displacer 2.

The working fluid which returns to the regenerator 7 from the expansion space 3 also cools the regenerator material inside the regenerator 7. Furthermore, the working fluid collected in the displacer 2 returns to the intake side of the compressor 12 via the regenerator 7 and the upper opening 11. The aforementioned step is performed as one cycle. The cryogenic refrigerator 1 cools the cooling stage 5 by repeating the cooling cycle.

Figure 2:
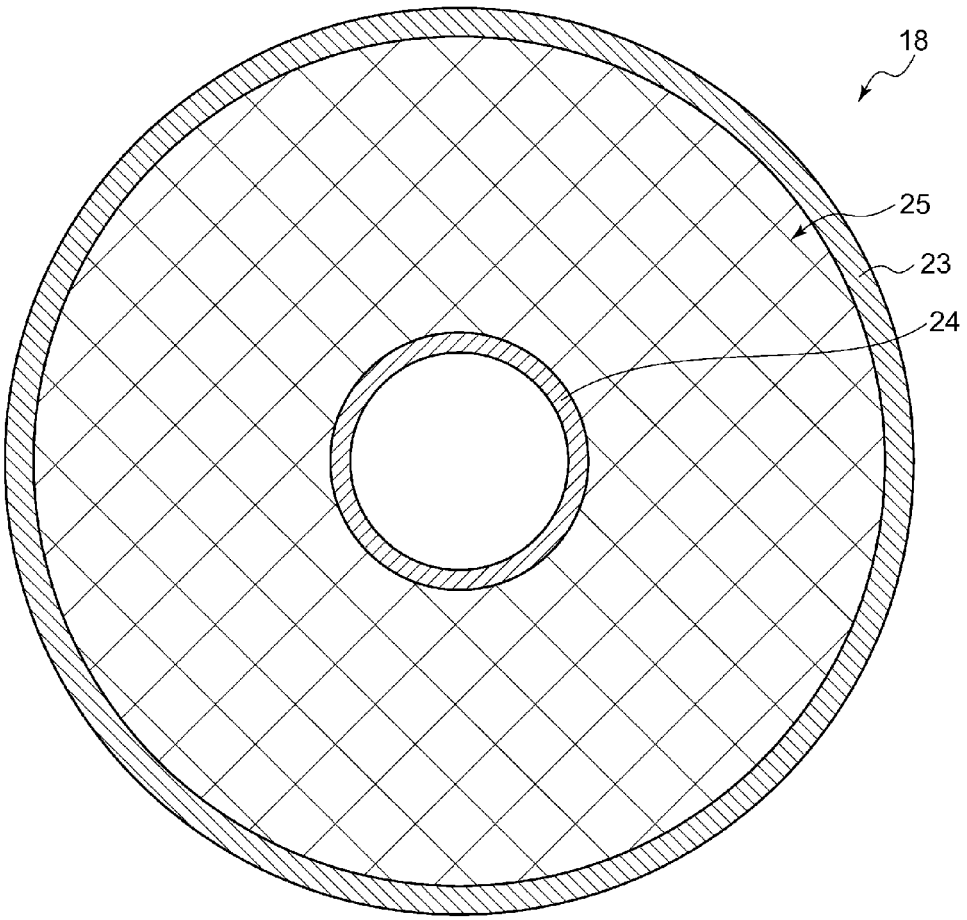
FIG. 2 is a diagram schematically illustrating an example of a heat exchanger according to the one embodiment.

FIG. 2 is a diagram schematically illustrating an example of the heat exchanger 18 according to the one embodiment. FIG. 2 is a schematic diagram illustrating a cross section which is taken by cutting the heat exchanger 18 on a plane perpendicular to the cylinder 4 in the axial direction. The heat exchanger 18 includes a reticular member 25. The heat exchanger 18 may also include an outer wall 23 and an inner wall 24.

The outer wall 23 is a cylindrical metal member. The inner wall 24 is also a cylindrical metal member similar to the outer wall 23. The diameter of the inner wall 24 is smaller than the diameter of the outer wall 23, and the inner wall 24 is disposed inside the outer wall 23. The reticular member 25 configured to be formed with metal mesh is accommodated between the outer wall 23 and the inner wall 24. Since the reticular member 25 is the aggregation of the wire gauze which is configured to be formed with the metal mesh, the working fluid can circulate therethrough. Since the reticular member 25 is held by the inner wall 24 and the outer wall 23, the reticular member 25 is prevented from moving when the working fluid circulates through the reticular member 25. The working fluid performs heat exchange with respect to the reticular member 25 when circulating through the reticular member 25.

Since the outer wall 23 and the inner wall 24 are metal cylinders, the working fluid is not allowed to pass therethrough. Therefore, the working fluid which flows in the heat exchanger 18 from the expansion space 3 does not escape from the heat exchanger 18 until the working fluid arrives at the flow channel 19. The diameter of the inner wall 24 is greater than the outer diameter of the flow channel 16, and there is the clearance between the inside of the inner wall 24 and the flow channel 16. Therefore, the flow channel 16 can reciprocate inside the inner wall 24. The clearance between the inside of the inner wall 24 and the flow channel 16 is sufficiently smaller than the mesh of the reticular member 25. Therefore, the working fluid which flows through the clearance between the inside of the inner wall 24 and the flow channel 16 from the expansion space 3 and arrives at the flow channel 16 is sufficiently smaller in quantity than the working fluid flowing through the reticular member 25.

As described above, the working fluid is decompressed inside the expansion space 3 and expands, thereby generating cooling. Therefore, the working fluid after expansion has high refrigeration capacity. Such working fluid mainly passes through the heat exchanger 18 and is collected in the internal space of the displacer 2. Thus, efficiency of heat exchange can be improved.

Meanwhile, the working fluid supplied from the internal space of the displacer 2 to the expansion space 3 is not low enough in temperature to cool the cooling stage 5. Therefore, the working fluid supplied to the expansion space 3 is considered to insignificantly contribute to refrigeration.

Therefore, in the cryogenic refrigerator 1 according to the one embodiment, the working fluid flows through only the first flow channel at the time immediately after the working fluid is supplied from the internal space of the displacer 2 to the expansion space 3. Since most of the working fluid is supplied to the expansion space 3 during the first half in the intake step, the heat of the warm working fluid can be considerably prevented from being conducted to the heat exchanger 18. In addition, since the second flow channel has flow channel resistance smaller than that of the first flow channel, pressure loss in the cryogenic refrigerator 1 can be prevented.

Figure 3:
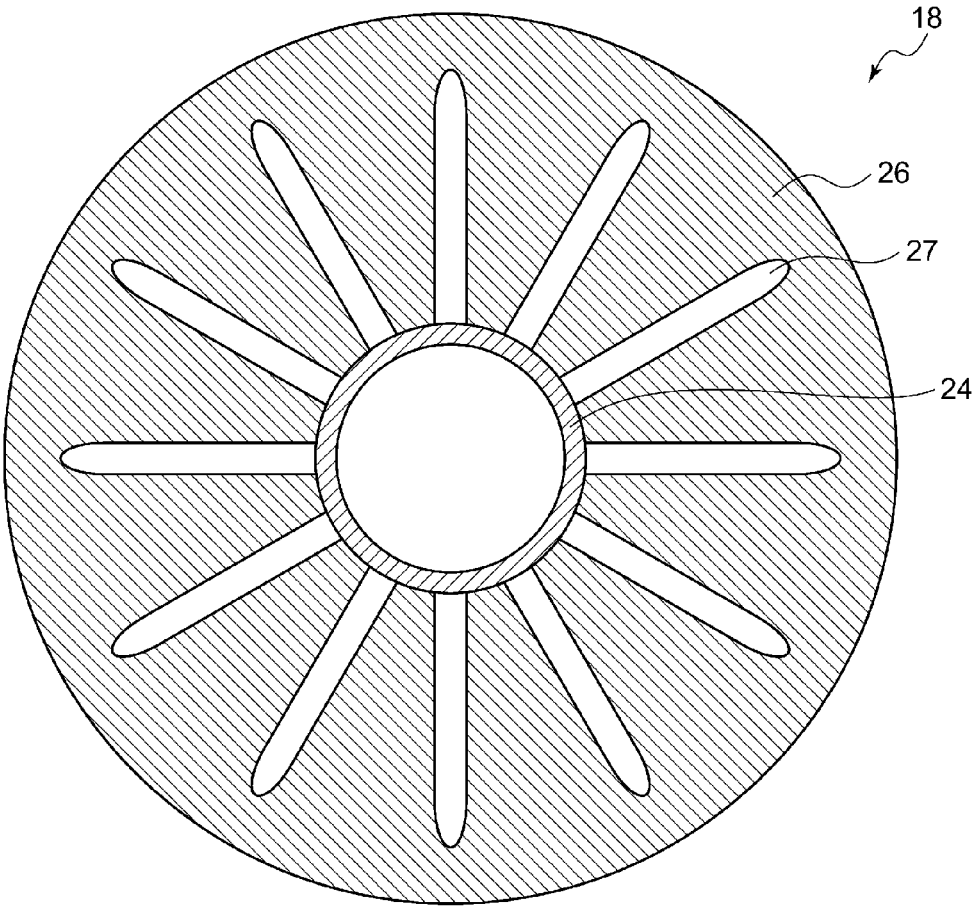
FIG. 3 is a diagram schematically illustrating another example of the heat exchanger according to the one embodiment.

FIG. 3 is a diagram schematically illustrating another example of the heat exchanger 18 according to one the embodiment. In the example illustrated in FIG. 3, the heat exchanger 18 is realized by using slits. To be more specific, in the heat exchanger 18 illustrated in FIG. 3, multiple slits 27 are provided in a columnar metal main body portion 26. Similar to the heat exchanger 18 illustrated in FIG. 2, a hole for allowing the flow channel 16 to reciprocate is provided at the center of the main body portion 26. The cylindrical metal inner wall 24 is provided between the hole and the slits 27.

The working fluid flowing through the slits 27 is blocked by the inner wall 24. Therefore, the working fluid which flows in the slits 27 from the expansion space 3 does not escape from the slits 27 until the working fluid arrives at the flow channel 19. The working fluid performs heat exchange with respect to the main body portion 26 while flowing through the slits 27. In this manner, in the example illustrated in FIG. 3, the multiple slits 27 function as the heat exchanger.

Similar to the heat exchanger 18 as illustrated in FIG. 2, in the heat exchanger illustrated in FIG. 3 as well, the clearance between the inner wall 24 and the outer wall of the flow channel 16 is sufficiently smaller than the slits 27. Therefore, substantially, a path of the working fluid from the expansion space 3 to the flow channel 16 is only the slits 27. In addition, since the multiple slits 27 exist, the total flow channel area of the slits 27 is greater than the flow channel area of the clearance 17 and the opening portion 21. Therefore, when the flow channel 16 is open, the working fluid inside the expansion space 3 mainly passes through the second flow channel and is collected in the internal space of the displacer 2. Accordingly, most of the working fluid of which refrigeration capacity is enhanced due to cooling generated through expansion passes through the heat exchanger 18 and is collected in the internal space of the displacer 2. For this reason, heat exchange efficiency of the cryogenic refrigerator 1 can be improved.

As described above, according to the cryogenic refrigerator 1 in the one embodiment, heat exchange efficiency between the working fluid and the heat exchanger 18 can be improved. Furthermore, heat exchange efficiency between the working fluid and the cooling stage 5 can be improved. In addition, the flow channel area at the time of supplying the working fluid from the internal space of the displacer 2 to the expansion space is enlarged, and thus, pressure loss in the cryogenic refrigerator 1 can be reduced. As a result, the refrigeration performance of the cryogenic refrigerator 1 can be improved.

Another Embodiment

The cryogenic refrigerator 1 according to another embodiment will be described. Hereinafter, descriptions overlapping with the cryogenic refrigerator 1 according to the one embodiment will be appropriately omitted or the descriptions will be given in a simplified manner.

Figure 4B:
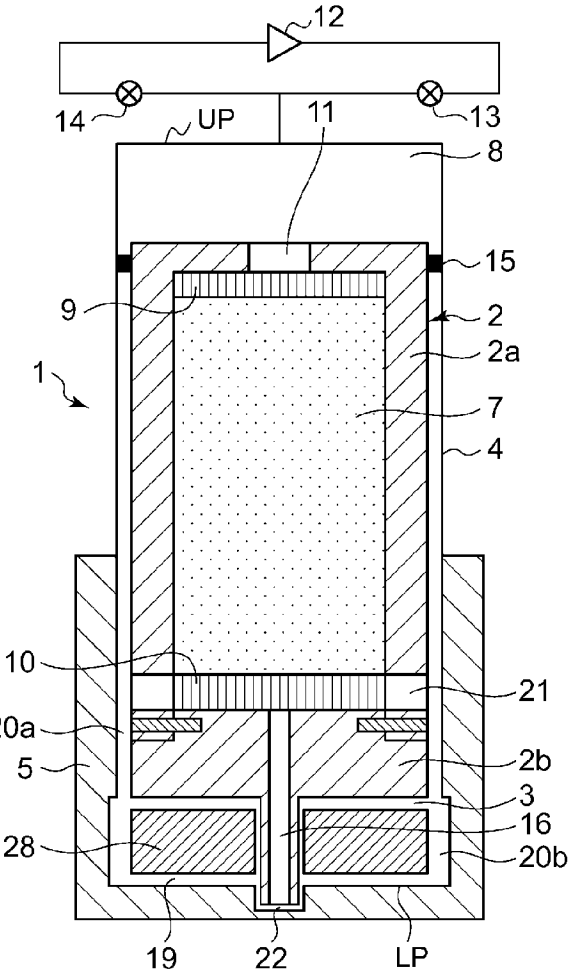
FIGS. 4A and 4B are diagrams schematically illustrating the cryogenic refrigerator according to another embodiment of the invention.
Figure 4A:
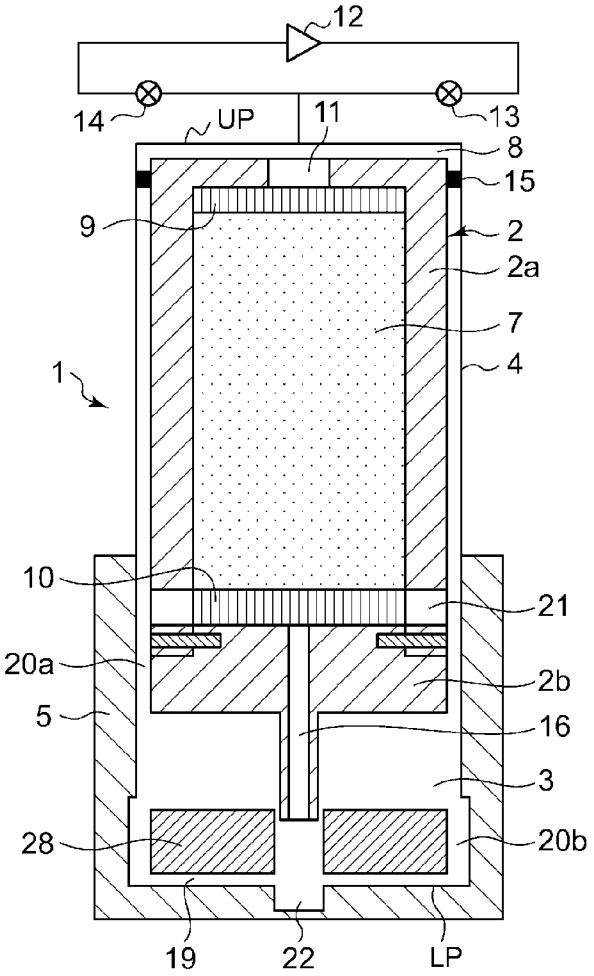

FIGS. 4A and 4B are diagrams schematically illustrating the cryogenic refrigerator 1 according to another embodiment of the invention. FIG. 4A is a schematic diagram illustrating a state where the displacer 2 is positioned at the upper dead center UP in the cryogenic refrigerator 1 according to another embodiment. In addition, FIG. 4B is a schematic diagram illustrating a state where the displacer 2 is positioned at the lower dead center LP in the cryogenic refrigerator 1 according to another embodiment of the invention.

In the cryogenic refrigerator 1 according to another embodiment, a shielding member 28 which impedes the circulation of the working fluid is included in a portion corresponding to the heat exchanger 18 of the cryogenic refrigerator 1 according to the one embodiment. A clearance 20*b* which serves as the working fluid flow channel is included between the outer wall of the shielding member 28 and the inner wall of the expansion space 3, that is, between the outer wall of the shielding member 28 and the inner wall of the cooling stage 5. A clearance 20*a* is similarly included in a portion corresponding to the clearance 17 of the cryogenic refrigerator 1 according to the one embodiment.

In addition, the clearance exists between the shielding member 28 and the bottom portion of the expansion space 3, thereby serving as the flow channel 19. Therefore, similar to the cryogenic refrigerator 1 according to the one embodiment, two flow channels which cause the internal space of the displacer 2 and the expansion space 3 to communicate with each other exist in the cryogenic refrigerator 1 according to the another embodiment as well. The first flow channel is the flow channel which is connected through the opening portion 21 and the clearance 20*a*. The second flow channel is the flow channel which is connected through the flow channel 16, the flow channel 19, and the clearance 20*b*.

In the cryogenic refrigerator 1 according to the another embodiment, the clearance 20*a* in the first flow channel functions as the heat exchanger. Similarly, the clearance 20*b* and the flow channel 19 in the second flow channel also functions as the heat exchanger. The heat exchange area in the second flow channel is greater than the heat exchange area in the first flow channel.

In the cryogenic refrigerator 1 according to the another embodiment, when the working fluid inside the expansion space 3 is collected in the internal space of the displacer 2, the working fluid flows through the first flow channel and the second flow channel. Accordingly, the equivalent heat exchange area increases, and thus, heat exchange efficiency of the cryogenic refrigerator 1 can be improved.

Similar to the cryogenic refrigerator according to the one embodiment, in the cryogenic refrigerator 1 according to the another embodiment as well, when the displacer 2 is at the lower dead center LP, the end portion of the flow channel 16 on the expansion space 3 side is accommodated in the receiver 22. The working fluid which is supplied from the internal space of the displacer 2 to the expansion space 3 and has small refrigeration capacity is prevented from flowing through the second flow channel. Since the heat exchange area in the second flow channel is greater than the heat exchange area in the first flow channel, the working fluid which insignificantly contributes to cooling flows through the second flow channel, and thus, depending on a case, the temperature of the cooling stage 5 can be prevented from rising.

When the end portion of the flow channel 16 on the expansion space 3 side arrives at the entrance of the receiver 22, the second flow channel is open. However, since most of the working fluid is supplied to the expansion space 3 during the first half of the intake step, a relatively small quantity of the working fluid flows through the second flow channel and is supplied to the expansion space 3. In addition, since the second flow channel is added to the first flow channel as the working fluid flow channel from the internal space of the displacer 2 to the expansion space 3, the working fluid flow channel area is enlarged. Accordingly, flow channel resistance of the working fluid decreases, and thus, pressure loss can be reduced.

The smallest flow channel area in the second flow channel may be configured to be greater than the smallest flow channel area in the first flow channel. In other words, the flow channel resistance of the second flow channel is caused to be smaller than the total flow channel resistance of the first flow channel. Accordingly, when the working fluid is collected in the internal space of the displacer 2 from the expansion space 3, most of the working fluid flows through the second flow channel. Since the second flow channel has the heat exchange area greater than that of the first flow channel, heat exchange efficiency can be raised further.

As described above, according to the cryogenic refrigerator 1 in another embodiment, it is possible to increase the heat exchange area at the time when refrigeration capacity of the working fluid is raised. Accordingly, heat exchange efficiency of the cryogenic refrigerator 1 can be improved. In addition, the flow channel resistance at the time of supplying the working fluid to the expansion space 3 can be decreased, and pressure loss in the cryogenic refrigerator 1 can be reduced. In this manner, according to the cryogenic refrigerator 1 in another embodiment, the refrigeration performance can be improved.

Hereinbefore, certain embodiments of the invention have been described with reference to the above-described embodiments. In the embodiments, various modification examples can be performed and arrangements can be changed without departing from the spirit of the embodiments of the invention defined in Claims.

For example, the above-described cryogenic refrigerator is illustrated in the case where the number of stages is one. However, it is possible to appropriately select the number of stages such as two or more. In addition, in each embodiment, descriptions are given regarding the example in which the cryogenic refrigerator is the GM refrigerator. However, the embodiments are not limited thereto. For example, the embodiments of the invention can also be applied to any refrigerator including the displacer, such as a Stirling refrigerator and a Solvay refrigerator.

In the one embodiment, descriptions are given regarding the case where the heat exchanger 18 is the aggregation of the wire gauze or the slits. However, the heat exchanger 18 is not limited to the case of the aggregation of the wire gauze or the slits. For example, the heat exchanger 18 can also be realized by using a sintered metal powder.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a displacer defining an internal space, the displacer for circulating a working fluid in the internal space;

a cylinder housing the displacer such as to enable the displacer to reciprocate, and forming, at an interval from a bottom surface of the displacer, an expansion space for the working fluid;

a cooling stage provided along an outer circumferential and bottom portion of the cylinder, in a location corresponding to the expansion space;

a heat exchanger arranged inside the expansion space, and thermally connected to the cooling stage;

an opening furnished in an expansion-space-ward end portion of the displacer, the opening constituting an entry/exit port between the internal space and the expansion space for the working fluid;

a working-fluid flow channel connecting the internal space and the expansion space via the heat exchanger; and a receiver provided in a bottom portion of the expansion space, for receiving an expansion-space-ward end portion of the flow channel such as to block circulation of the working fluid at least when the displacer is at bottom dead center, the receiver thereby functioning as a valve in the flow channel.

2. The cryogenic refrigerator according to claim 1, wherein the receiver is of depth-wise dimension less than or equal to half the displacer's stroke length.

3. The cryogenic refrigerator according to claim 1, wherein the heat exchanger is either a wire-mesh assembly, or slits.

4. The cryogenic refrigerator according to claim 1, wherein:

a first flow channel comprising a clearance communicating with the opening is provided between a sidewall of the displacer and an inner wall of the cylinder;

the working-fluid flow channel constitutes a second flow channel; and flow channel resistance of the first flow channel is greater than flow channel resistance of the second flow channel.

5. The cryogenic refrigerator according to claim 1, wherein the flow channel includes a conduit formed in a bottom portion of the displacer, protruding into the expansion space.

* * * * *